US007922705B2

(12) United States Patent
Ampulski

(10) Patent No.: US 7,922,705 B2
(45) Date of Patent: Apr. 12, 2011

(54) DENSIFIED FIBROUS STRUCTURES AND METHODS FOR MAKING SAME

(75) Inventor: Robert Stanley Ampulski, Fairfield, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 408 days.

(21) Appl. No.: 11/242,253

(22) Filed: Oct. 3, 2005

(65) Prior Publication Data

US 2007/0074832 A1 Apr. 5, 2007

(51) Int. Cl.
*A61F 13/15* (2006.01)

(52) U.S. Cl. ..... 604/385.101; 604/378; 604/379; 604/380; 604/367; 604/374; 604/375

(58) Field of Classification Search ..... 604/367, 604/374, 375, 378, 379, 380; 162/112, 113, 162/72, 84

See application file for complete search history.

(56) References Cited

U.S. PATENT DOCUMENTS

| | | | | |
|---|---|---|---|---|
| 3,301,746 | A * | 1/1967 | Sisson et al. | 162/113 |
| 4,634,499 | A | 1/1987 | Ampulski | |
| 4,734,162 | A | 3/1988 | Ampulski | |
| 5,116,474 | A | 5/1992 | Fuentes et al. | |
| 5,725,732 | A | 3/1998 | Cooper, III | |
| 5,770,012 | A | 6/1998 | Cooper, III | |
| 6,146,494 | A * | 11/2000 | Seger et al. | 162/9 |
| 6,180,382 | B1 | 1/2001 | De Buyl et al. | |
| 6,423,523 | B1 | 7/2002 | De Buyl et al. | |
| 6,468,391 | B1 | 10/2002 | Sharyo et al. | |
| 6,635,146 | B2 | 10/2003 | Lonsky et al. | |
| 6,635,464 | B1 | 10/2003 | Paloheimo et al. | |
| 6,790,527 | B1 | 9/2004 | Luo et al. | |
| 6,808,595 | B1 | 10/2004 | Burns et al. | |
| 6,824,646 | B2 | 11/2004 | Izumi et al. | |
| 6,861,023 | B2 | 3/2005 | Sealey, II et al. | |
| 6,939,437 | B1 | 9/2005 | Hill, Jr. et al. | |
| 2002/0084046 | A1 | 7/2002 | Hsu et al. | |
| 2004/0069426 | A1 | 4/2004 | Sika-Aho et al. | |
| 2005/0000666 | A1 | 1/2005 | Taylor et al. | |
| 2005/0088575 | A1 | 4/2005 | Ishida | |

FOREIGN PATENT DOCUMENTS

| | | | |
|---|---|---|---|
| EP | 0 524 220 | B1 | 11/1994 |
| EP | 0 583 310 | B1 | 10/1996 |
| EP | 0 755 468 | B1 | 5/2000 |
| EP | 0 876 534 | B1 | 5/2001 |
| EP | 0 764 226 | B1 | 12/2001 |
| EP | 0 545 958 | B2 | 7/2003 |
| JP | 03088801 | A | 4/1991 |
| JP | 05222688 | A | 8/1993 |
| JP | 2000220087 | A | 8/2000 |
| JP | 2005042296 | A | 2/2005 |
| WO | WO 92/03541 | | 3/1992 |
| WO | WO 97/27363 | | 7/1997 |
| WO | WO 2004/101889 | A2 | 11/2004 |

* cited by examiner

*Primary Examiner* — Jacqueline F. Stephens
(74) *Attorney, Agent, or Firm* — C. Brant Cook

(57) ABSTRACT

Differentially densified fibrous structures, methods for making same, and processes for treating fibers used in the fibrous structures are provided. More particularly, fibrous structures comprising two or more regions, at least one of which exhibits a density that is at least 1.6 times greater than another region within the fibrous structure, methods for making such fibrous structures and non-naturally occurring fibers useful in such fibrous structures are provided.

7 Claims, 2 Drawing Sheets

DENSIFIED FIBROUS STRUCTURES AND METHODS FOR MAKING SAME

FIELD OF THE INVENTION

The present invention relates to differentially densified fibrous structures, methods for making same, and processes for treating fibers used in the fibrous structures. More particularly, the present invention relates to fibrous structures comprising two or more regions, at least one of which exhibits a density that is at least 1.6 times greater than another region within the fibrous structure, methods for making such fibrous structures and non-naturally occurring fibers useful in such fibrous structures.

BACKGROUND OF THE INVENTION

Formulators of fibrous structures have conventionally been faced with a contradiction. Formulators have desired to increase tensile breaking strength of fibrous structures, however, doing so also brings about the effect of negatively increasing the drainage properties (as measured by pfr) of the fibrous structure. In through-air-dried processes for making fibrous structures, the incremental increase in tensile breaking strength has not been worth the negative increase in drainage properties due to the amount of energy needed to remove the additional water during the wet-laid fibrous structure making process. These negatives are not present during a wet-pressing fibrous structure making process.

Accordingly, there is a need, especially for through-air-dried fibrous structures, to increase tensile breaking strength without negatively increasing the drainage properties of the fibers and/or fibrous structure containing such fibers. In addition, there is a need for a process for making such fibrous structures, for treating fibers used in such fibrous structures, and for making sanitary tissue products comprising such fibrous structures.

SUMMARY OF THE INVENTION

The present invention fulfills the needs described above by providing a differentially densified fibrous structure, processes for making such a fibrous structure, processes for treating fibers used in such a fibrous structure, and sanitary tissue products comprising such a fibrous structure.

In one example of the present invention, a fibrous structure comprising a first region and a second region, wherein the first region is directly connected to the second region without an intermediate transition region, wherein a ratio of the first region density to the second region density is greater than 1.6, is provided.

In another example of the present invention, a non-naturally occurring fiber that exhibits a greater tensile breaking strength than its naturally occurring state, is provided.

In still another example of the present invention, a process for treating pulp, the process comprises the step of contacting digested pulp with cellulose-binding domain containing cellulase enzyme, is provided.

In yet another example of the present invention, a fibrous structure comprising a non-naturally occurring fiber according to the present invention is provided.

In even yet another example of the present invention, a process for making a fibrous structure, the process comprising the step of creating a first region and a second region within a fibrous structure, wherein the first region is directly connected to the second region without an intermediate transition region, wherein a ratio of the first region density to the second region density is greater than 1.6, is provided.

Accordingly, the present invention provides a differentially densified fibrous structure, processes for making such a fibrous structure, and processes for treating fibers for use in such a fibrous structure.

DETAILED DESCRIPTION OF THE INVENTION

Definitions

Figure 1:
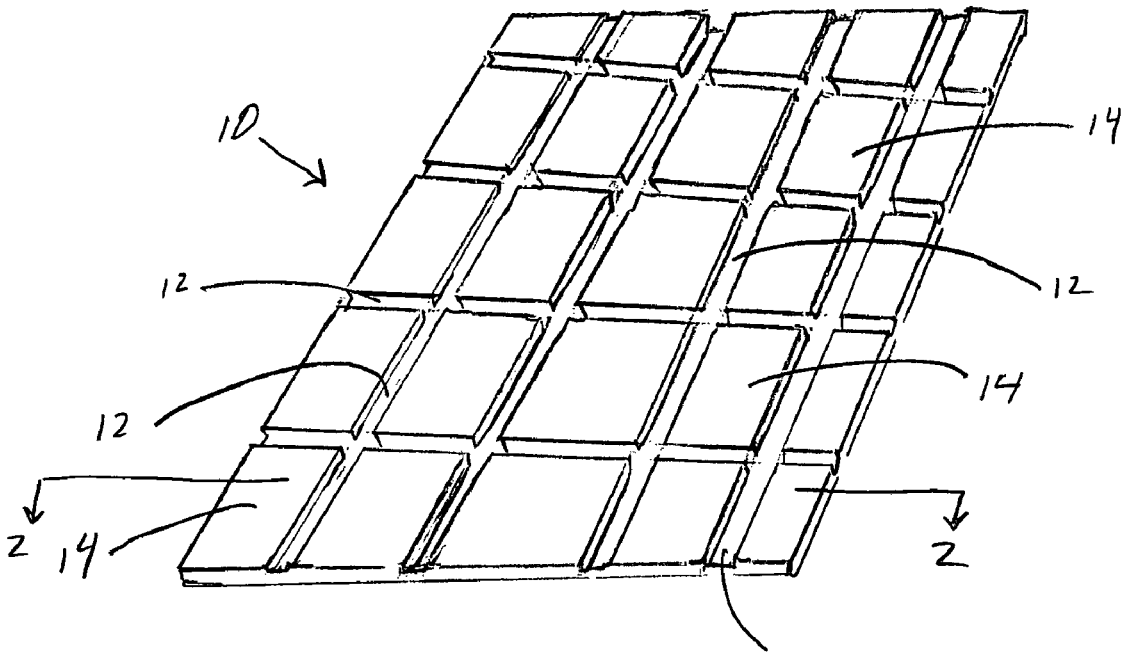
FIG. 1 is a schematic representation of a fibrous structure in accordance with the present invention.

"Pulp fiber" or "Wood fiber" as used herein means a virgin fiber obtained from a tree. Pulp may be chemical pulps, such as kraft (sulfate) and sulfite pulps, as well as mechanical and semi-chemical pulps including, for example, groundwood, thermomechanical pulp, chemi-mechanical pulp (CMP), chemi-thermomechanical pulp (CTMP), neutral semi-chemical sulfite pulp (NSCS).

The pulp fibers may be short (typical of hardwood fibers) or long (typical of softwood fibers).

"Hardwood pulp fiber" as used herein means virgin pulp fibers obtained from deciduous trees. Nonlimiting examples of deciduous trees include Northern hardwood trees and tropical hardwood trees. Nonlimiting examples of hardwood pulp fibers include hardwood pulp fibers obtained from a fiber source selected from the group consisting of Acacia, Eucalyptus, Maple, Oak, Aspen, Birch, Cottonwood, Alder, Ash, Cherry, Elm, Hickory, Poplar, Gum, Walnut, Locust, Sycamore, Beech, Catalpa, Sassafras, Gmelina, Albizia, Anthocephalus, and Magnolia.

"Tropical hardwood pulp fiber" as used herein means virgin pulp fibers obtained from a tropical hardwood tree. Nonlimiting examples of tropical hardwood trees include Eucalyptus trees and/or Acacia trees.

"Naturally occurring pulp fiber" as used herein means a virgin pulp fiber that is found in nature, which has not been modified and/or treated by humans through a human-designed process and/or a human executed modifying and/or treating process. For purposes of the present invention, conventional pulping processes (without inclusion of enzymes) produces naturally occurring pulp fibers.

"Non-naturally occurring pulp fiber" as used herein means a naturally occurring pulp fiber that has been modified and/or treated by humans through a human-designed process and/or a human executed modifying and/or treating process. A naturally occurring pulp fiber that has been treated with an enzyme during the pulping process is a non-naturally occurring pulp fiber.

In one example of the present invention, a non-naturally occurring pulp fiber exhibits a greater tensile breaking strength than its naturally occurring state.

In another example of the present invention, a non-naturally occurring pulp fiber exhibits greater flexibility and/or elastic modulus and/or stretch than its naturally occurring state.

"Fibrous structure" as used herein means a structure that comprises one or more fibers. Nonlimiting examples of processes for making fibrous structures include known wet-laid papermaking processes and air-laid papermaking processes. Such processes typically include steps of preparing a fiber composition, oftentimes referred to as a fiber slurry in wet-laid processes, either wet or dry, and then depositing a plurality of fibers onto a forming wire or belt such that an embryonic fibrous structure is formed, drying and/or bonding the fibers together such that a fibrous structure is formed, and/or further processing the fibrous structure such that a finished fibrous structure is formed. For example, in typical papermaking processes, the finished fibrous structure is the fibrous structure that is wound on the reel at the end of papermaking, but before converting thereof into a sanitary tissue product.

Nonlimiting types of fibrous structures according to the present invention include conventionally felt-pressed fibrous structures; pattern densified fibrous structures; and high-bulk, uncompacted fibrous structures. The fibrous structures may be of a homogeneous or multilayered (two or three or more layers) construction; and the sanitary tissue products made therefrom may be of a single-ply or multi-ply construction.

The fibrous structures may be post-processed, such as by embossing and/or calendaring and/or folding and/or printing images thereon.

The fibrous structures may be through-air-dried fibrous structures or conventionally dried fibrous structures.

The fibrous structures may be creped or uncreped.

The fibrous structures of the present invention may comprise, in addition to non-naturally occurring hardwood pulp fibers, naturally occurring pulp fibers, such as naturally occurring hardwood pulp fibers, naturally occurring softwood pulp fibers, synthetic fibers, naturally occurring animal fibers, other naturally occurring plant fibers, and other non-naturally occurring fibers. The fibers may be in different layers within the fibrous structure or may be blended together in a single layer.

"Differentially densified" as used herein means that the fibrous structure comprises two or more regions that differ in density from each other. For example, the fibrous structure may comprise areas of high density and areas of low density. The different areas may be in the form of a pattern, such as a pattern densified fibrous structure. For purposes of the present invention, density is analogous to and/or is measured by and/or correlates to thickness (since basis weight in the fibrous structures of the present invention is uniform). In other words, lower thickness means higher density and higher thickness means lower density.

"Sanitary tissue product" comprises one or more fibrous structures, converted or not, that is useful as a wiping implement for post-urinary and post-bowel movement cleaning (toilet tissue), for otorhinolaryngological discharges (facial tissue and/or disposable handkerchiefs), and multi-functional absorbent and cleaning uses (absorbent towels and/or wipes).

"Ply" or "Plies" as used herein means an individual finished fibrous structure optionally to be disposed in a substantially contiguous, face-to-face relationship with other plies, forming a multiple ply finished fibrous structure product and/or sanitary tissue product. It is also contemplated that a single fibrous structure can effectively form two "plies" or multiple "plies", for example, by being folded on itself.

Enzymes

In one example of the present invention, the non-naturally occurring hardwood pulp fibers of the present invention may be derived from enzymatically treating naturally occurring hardwood pulp fibers. The enzyme or enzyme composition useful in enzymatically treating the naturally occurring hardwood pulp fibers comprises a cellulase enzyme. In one example, the cellulase enzyme contains a cellulose binding domain. In other words, the cellulase enzyme is not a truncated enzyme.

In another example, the cellulase enzyme comprises an endoglucanase enzyme. In one example, the endoglucanase enzyme contains a cellulose binding domain. In other words, the cellulase enzyme is not a truncated enzyme.

In yet another example, the cellulase enzyme comprises an alkaline cellulase.

In even yet another example, the cellulase enzyme comprises a monocomponent alkaline cellulase.

Nonlimiting examples of suitable cellulase enzymes useful in the present invention include Novozym® 476, a non-truncated cellulase, Novozym® 613, a non-truncated endoglucanase, and other cellulases and endoglucanases, commercially available from Novozymes A/S of Denmark.

In one example, a cellulase enzyme, such as Novozym® 476 and/or Novozym® 613, is added to the pulping process, such as after the digestion step but before the bleaching step, at a level of at least about 0.0001% and/or at least about 0.001% and/or at least about 0.01% to about 10% and/or to about 8% and/or to about 6% and/or to about 3% and/or to about 1% and/or to about 0.5% by weight of the pulp fibers.

Treating Process

The process for treating pulp fibers in accordance with the present invention comprises the step of contacting naturally occurring pulp fibers with an enzyme, such as a cellulase enzyme. In one example, the cellulase enzyme comprises a cellulose-binding domain.

In one example, the naturally occurring pulp fibers are naturally occurring hardwood pulp fibers.

In another example, the naturally occurring pulp fibers are contacted by the enzyme after the naturally occurring pulp fibers have been subjected to a digestion step.

In yet another example, the naturally occurring pulp fibers are contacted by the enzyme prior to the naturally occurring pulp fibers being bleached.

In even another example, the naturally occurring pulp fibers are contacted by the enzyme in the absence of any bleach or other enzyme-degrading conditions.

In one example, naturally occurring pulp fibers obtained from a hardwood tree are subjected to a digestion step. After and/or during the digestion step, the naturally occurring pulp fibers are contacted by an enzyme. After the naturally occurring pulp fibers have been treated by the enzyme to produce non-naturally occurring pulp fibers, the non-naturally occurring pulp fibers are subjected to a bleaching process. The bleaching process is then followed by a drying process which results in non-naturally occurring pulp fibers (oftentimes in bales) that are ready for use in papermaking processes, such as wet-laid and/or air-laid papermaking processes (fibrous structure making processes).

One of ordinary skill in the art will appreciate that enzymes, especially other enzymes other than the cellulase enzymes of the present invention, may be used during the pulping process, such as prior to and/or during the digestion step, and/or after and/or during the bleaching step.

Fibrous Structures

Figure 2:
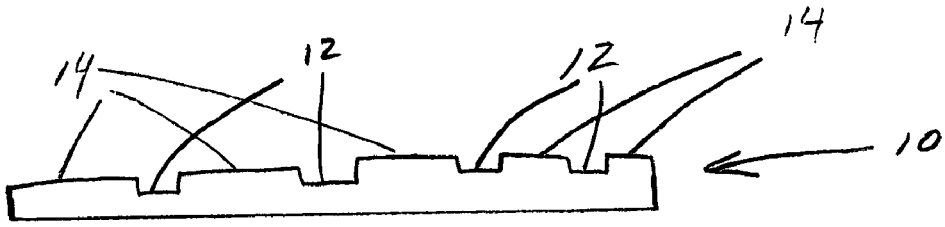
FIG. 2 is a cross-sectional view of FIG. 1 taken along line 2-2.

As shown in FIGS. 1 and 2, a fibrous structure 10 of the present invention comprises a first region 12 and a second region 14, wherein the first region 12 and second region 14 are directly connected to one another without an intermediate transition region.

The first region 12 exhibits a density that is greater than 1.4 and/or greater than 1.5 and/or greater than 1.6 and/or greater than 1.7 and/or greater than 1.8 times the density of the second region 14. The first region 12 is often referred to as a "knuckle" and the second region 14 is often referred to as a "pillow."

The first region 12 may be present in the fibrous structure 10 in the form of a continuous network, as shown in FIG. 1. Alternatively, the first region 12 may be present in the fibrous structure 10 in the form of a discontinuous network. In one example, the first region 12 may be present in the fibrous structure 10 in the form of discrete regions.

The fibrous structure of the present invention may comprise one or more non-naturally occurring fibers.

The fibrous structure of the present invention may exhibit a ratio of tensile breaking strength to pfr of greater than about 4.0 and/or greater than about 4.3 and/or greater than about 4.5 and/or greater than about 4.7.

In another example, the fibrous structure of the present invention may exhibit a ratio of tensile breaking strength to pfr of greater than about 1.05 times and/or greater than about 1.10 times and/or greater than about 1.20 times and/or greater than about 1.25 times that of a fibrous structure without non-naturally occurring fibers (especially a fibrous structure that does not contain enzyme-treated pulp fibers).

The fibrous structure of the present invention may be incorporated into a single- or multi-ply sanitary tissue product.

Fibrous Structure Making Process

The fibrous structures of the present invention may be made by any suitable process known in the art.

In one example, the fibrous structures of the present invention are made by a wet-laid process.

In another example, the fibrous structures of the present invention are made by a through-air-dried process. In one example, the through-air-dried process comprises the step of through air drying the fibrous structure on a fabric belt and/or on a three-dimensional molding member that results in two or more regions, such as pillows and knuckles, being formed within the fibrous structure. Pressure may be applied to the fibrous structure while it is in contact with the fabric belt and/or three-dimensional molding member such that differential density regions are formed within the fibrous structure.

In yet another example, the fibrous structures of the present invention are made by a process comprising the step of creating a first region and a second region within a fibrous structure, wherein the first region is directly connected to the second region without an intermediate transition region, wherein a ratio of the first region density to the second region density is greater than 1.6.

Test Methods

Unless otherwise indicated, all tests described herein including those described under the Definitions section and the following test methods are conducted on samples, fibrous structure samples and/or sanitary tissue product samples and/or handsheets that have been conditioned in a conditioned room at a temperature of 73° F.±4° F. (about 23° C.±2.2° C.) and a relative humidity of 50%±10% for 2 hours prior to the test. Further, all tests are conducted in such conditioned room. Tested samples and felts should be subjected to 73° F.±4° F. (about 23° C.±2.2° C.) and a relative humidity of 50%±10% for 2 hours prior to testing.

A. Measurement of Thickness

The thickness and elevations of various sections of a sample of a fibrous structure are measured from SEM micrographs of microtome cross-sections of the fibrous structure. The microtome cross-section is made from a sample of fibrous structure measuring about 2.54 centimeters by 5.1 centimeters (1 inch by 2 inches). The sample is marked with reference points to determine where microtome slices are made. A Spurr resin is poured into a mold containing the sample. The sample is completely immersed in the resin. The resin is cured. The cured resin block is trimmed and cut close to the reference points to form a sample block. The sample block is further polished and etched to expose the sample between the reference points. The etched sample block is coated with an Au—Pt coating and observed by scanning electron microscopy (SEM). Panoramic micrographs are taken of the surface of the sample block at a magnification of approximately 33×.

The thickness of the areas of interest may be established by using a suitable CAD computer drafting software such as Power Draw version 4.0 available from Engineered Software of North Carolina. The panoramic micrographs obtained supra. are selected, copied, and then pasted in Power Draw. Individual photomicrographs are arranged in series to reconstruct the profile of the slice. The appropriate calibration of the system is performed by using the SEM distance reference line drawn on the photomicrograph and scaling the CAD software.

The thickness at any particular point in a region of interest can be determined by drawing lines that can be fit inside the region at that particular point without exceeding the boundaries of the image. The thickness of the region at that point is the length of the line.

Figure 3:
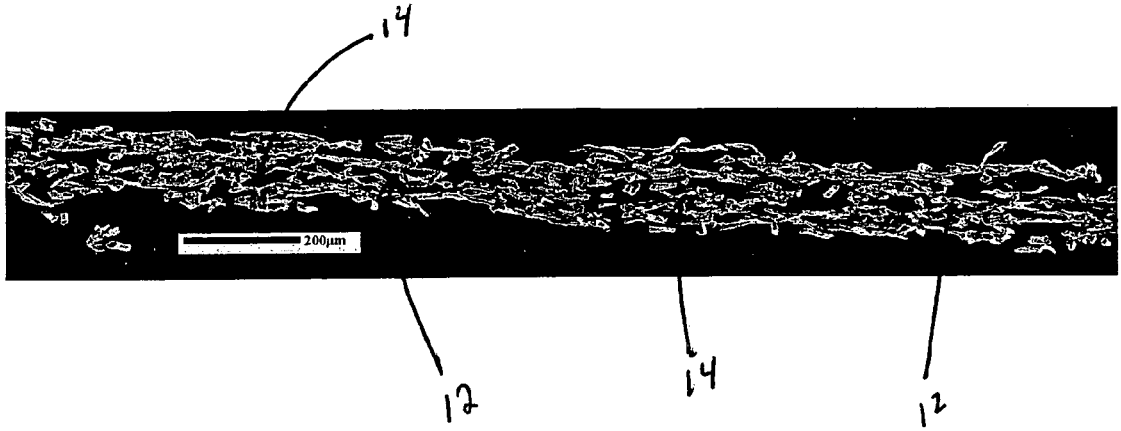
FIG. 3 is a SEM micrograph of a microtome cross-section of a fibrous structure.

A SEM micrograph of such a microtome cross-section of a prior art fibrous structure is shown in FIG. 3, wherein 12 is a knuckle having a thickness K and 14 is a pillow having a thickness P within the fibrous structure.

Figure 4:
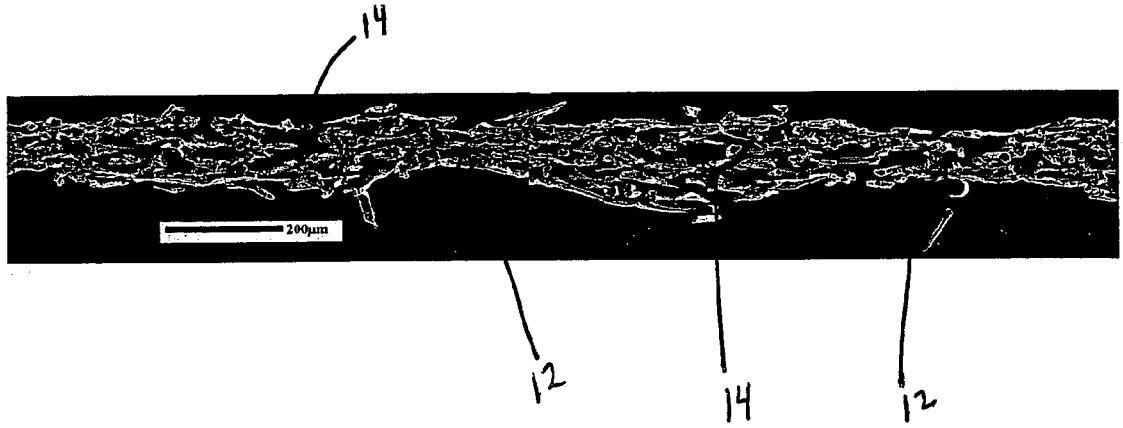
FIG. 4 is a SEM micrograph of a microtome cross-section of a fibrous structure in accordance with the present invention.

FIG. 4 is a SEM micrograph of a microtome cross-section of a fibrous structure according to the present invention, wherein 12 is a knuckle having a thickness K and 14 is a pillow having a thickness P within the fibrous structure.

Thickness Ratios

Referring to FIG. 4, the thicknesses K of the relatively high density region, and P of the relatively low density region are measured according to the following procedure.

First, a cross-section is located having a portion of a knuckle extending intermediate two pillow regions. The thickness of the knuckle, K is measured using the distance measuring tool The reported thickness ratio P/K is the average of the ratio P/K for at least 50 knuckle and 50 pillow measurements. The 50 pillow measurements are averaged to give a value for P and 50 knuckle values are averaged to give a value for K.

Tensile Breaking Strength/Tensile Index

Tensile Breaking Strength (TB) of fibrous structures as used herein means the maximum strength of the machine direction (in kilograms/meter). The Tensile Index (TI) is the Tensile Breaking Strength divided by the basis weight of the sample (in g/m$^2$ or gsm). The value of TI is reported in meters. The breaking strength is measured using a tensile test machine, such as an Intelect II STD, available from Thwing-Albert, Philadelphia, Pa. The maximum strength is measured at a cross head speed of 0.5 inch per minute for uncreped handsheet samples. The value of TB is reported as an average of at least five measurements. The value for TB is corrected to a constant basis weight of 26.8 gsm by taking the measured tensile value of the breaking strength and multiplying by the following basis weight correction factor (BWCF): BWCF=(17.08/(MBWV−9.76) where MBWV is the measured basis weight value.

Web (Fibrous Structure) Stiffness

Web stiffness as used herein is defined as the slope of the tangent of the graph of force in grams/centimeter of sample width) versus strain (cm elongation per cm of gage length). Web flexibility increases, and web stiffness decreases, as the slope of the tangent decreases. For creped samples the tangent slope is obtained at 15 g/cm force, and for non-creped samples the tangent slope is obtained at 40 g/cm force. Such data may be obtained using an Intelect II STD tensile test machine, available from Thwing-Albert, Philadelphia, Pa., with a cross head speed of 0.5 inch per minute and a sample width of about 1 inch for non-creped fibrous structures. The Total Stiffness (TS) as used herein means the tangent slope. For handsheets, only the machine direction tangent slope is measured, and the value of TS is taken to be the machine direction tangent slope. The value of TS is reported as an average of at least five measurements. The reported value for TS is corrected for basis weight by multiplying the measured value by BWCF. In Table 1 TS is normalized by Total Breaking Strength to provide a normalized stiffness index TS/TB.

Caliper

Macro-caliper as used herein means the macroscopic thickness of the sample. The sample is placed on a horizontal flat surface and confined between the flat surface and a load foot having a horizontal loading surface, where the load foot loading surface has a circular surface area of about 3.14 square inches and applies a confining pressure of about 15 g/square cm (0.21 psi) to the sample. The macro-caliper is the resulting gap between the flat surface and the load foot loading surface. Such measurements can be obtained on a VIR Electronic Thickness Tester Model II available from Thwing-Albert, Philadelphia, Pa. The macro-caliper is an average of at least five measurements.

Basis Weight

Basis weight as used herein is the weight per unit area of a tissue sample reported in grams per square meter.

Pulp Filtration Resistance The pulp filtration resistance (pfr) can be obtained by measuring the Canadian Standard Freeness (CSF). CSF is related to pfr by the following equation:

$$pfr=78918*CSF^{-1.4688}.$$

Apparent Density

Apparent density as used herein means the basis weight of the sample divided by the Macro-caliper.

NONLIMITING EXAMPLES

Example 1

Enzyme Treatment of Pulp

Five hundred bone dry grams of Oxygen delignified eucalyptus kraft brown stock are diluted to approximately 15% consistency with water. (The brown stock is diluted to a starting consistency above 10% in order to obtain a consistency of exactly 10% after pH adjustment and enzyme addition). A Hobart mixer is used for pH adjustment of the diluted brown stock prior to enzyme addition and for mixing. The pH of the diluted brown stock is adjusted to pH 7 before enzyme addition. 0.5 grams of Novozym® 613 enzyme is diluted with cold water before addition to the diluted brown stock in order to enable uniform mixing of the enzyme into the diluted brown stock. The diluted enzyme is mixed into the diluted brown stock. The diluted brown stock/enzyme mixture is adjusted to a final consistency of approximately 10% (i.e., a pulp slurry). The pulp slurry is placed in heavy-duty plastic bags and submerged in a water bath for incubation at the 50° C. At the time intervals of 0, 15 and 300 minutes 1000 grams of solution (100 g pulp) is removed from the reaction bag. The reaction is quenched by dilution with 2 L of cold water and further washing with cold water. The samples are then bleached using a standard bleaching sequence (e.g., $D_0$,EOP, D,E,D). The time=0 condition is taken from the diluted, pH and temperature adjusted stock pulp before enzyme addition. This stock pulp is diluted, washed and bleached in a manner equivalent to the enzyme treated samples.

Example 2

Fibrous Structure (Handsheet) Preparation with Enzyme Treated Fibers

A noncreped fibrous structure made without the use of a through air dryer is prepared as follows. 30 grams of bleached Eucalyptus hardwood pulp is defibered in 2000 ml water to form a defibered pulp slurry. The defibered pulp slurry is then diluted to 0.1% consistency on a dry fiber basis in a 20,000 ml proportioner to form a diluted pulp slurry. A volume of about 2543 ml of the diluted pulp slurry is added to a deckle box containing 20 liters of water. The bottom of the deckle box contains a 33 cm by 33 cm (13.0 inch by 13.0 inch) Polyester Monofilament plastic Fourdrinier wire supplied by Appleton Wire Co. Appleton, Wis. The wire is of a 5-shed, satin weave configuration having 84 machine-direction and 76 cross-machine-direction monofilaments per inch, respectively. The filament size is approximately 0.17 mm in both directions. The fiber slurry is uniformly distributed onto the wire by moving a perforated metal deckle box plunger from near the top of the fiber slurry to the bottom of the fiber slurry back and forth for three complete "up and down" cycles. The "up and down" cycle time is approximately 2 seconds. The plunger is then withdrawn slowly. The water is then filtered through the wire. After the water is drained through the wire the deckle box is opened and the wire and the embryonic fibrous structure are removed. The wire containing the embryonic fibrous structure is next pulled across a vacuum slot to further dewater the embryonic fibrous structure. The peak vacuum is approximately 4 in Hg. The embryonic fibrous structure is transferred from the wire, at a fiber consistency of about 15% at the point of transfer, to an imprinting member described below.

The imprinting member is a 40.64 cm by 35.56 cm (16 in by 14 in) polyster monofilament plastic cloth supplied by Appleton Wire Co., Appleton, Wis. It has a (2S) square weave configuration with 36 machine-direction and 30 cross machine-direction monofilaments per inch, respectively. The warp and weft filament size is approximately 0.40 mm. The imprinting member is cut such that there are 36 filaments per inch in the 14 in. direction and 30 filaments per inch in the 16 inch direction. In use, the 16 in. length will be perpendicular to the vacuum slot.

The transfer to the imprinting member is accomplished by forming a "sandwich" of the imprinting member, the embryonic fibrous structure, and the wire. The "sandwich" is pulled across a vacuum slot to complete the transfer. The peak vacuum is about 10 in. Hg. The wire is then removed from the "sandwich", leaving a non-monoplanar, patterned fibrous structure supported on the imprinting member. The fibrous structure has a fiber consistency of about 20%. The fibrous structure is further dried by contacting a steam drum dryer. The drum has a circumference of approximately 1 meter. It rotates at a rate of approximately 0.9 rpm at a temperature of approximately 230° F. The dryer is wrapped with an endless wool felt 203 cm (80 inches) in circumference by 40.64 cm (16 in wide) (No. 11614 style x225) Nobel and Wood Lab Machine Company, Hoosick Falls, N.Y. The fibrous structure is dried by first passing the imprinting member with the fibrous structure attached through the drum dryer with the imprinting member next to the drum dryer. Next, the imprinting member with the fibrous structure attached is passed through the drum dryer a second time with the fibrous structure next to the drum dryer. The fibrous structure is carefully removed while the fibrous structure is still warm. The fibrous structure is conditioned as described supra before testing. The basis weight of the resulting densified fibrous structure is 26.8 $g/m^2$. The tensile breaking strength of the enzyme-treated fibrous structure (i.e., densified fibrous structure of the present invention) is greater than the tensile breaking strength of a base fibrous structure made with the same furnish, wire, imprinting member, transfer conditions, and drying but without enzyme treated-non-naturally occurring pulp fibers. Comparative data for this example is shown in Table 1.

TABLE 1

| Property | Control Fibrous Structure | Enzyme Treated Fibrous Structure (15 min) | Enzyme Treated Fibrous Structure (300 min) |
|---|---|---|---|
| Peak Load (kg/m) | 27.8 | 38.7 | 35.9 |
| Tangent Slope (kg/m) | 4123.5 | 5040.7 | 4030.5 |
| MBWV ($g/m^2$) | 28.2 | 28.8 | 27.5 |
| BWCF | 0.927 | 0.895 | 0.961 |
| Basis Wt. ($g/m^2$) | 26.8 | 26.8 | 26.8 |
| TB (kg/m) | 25.8 | 34.6 | 34.5 |
| TS (kg/m) | 3823.6 | 4510.8 | 3874.3 |
| TS/TB | 148.4 | 130.2 | 112.3 |
| CSF | 600 | 575 | 580 |
| pfr | 6.6 | 7 | 6.9 |
| TB/pfr | 3.9 | 4.9 | 5.0 |
| Caliper (μm) | 208 | 193 | 208 |
| K (μm) | 119 | 89 | 83 |
| P (μm) | 162 | 165 | 162 |
| P/K | 1.36 | 1.86 | 1.94 |

All documents cited in the Detailed Description of the Invention are, in relevant part, incorporated by reference herein; the citation of any document is not to be construed as an admission that it is prior art with respect to the present invention. To the extent that any meaning or definition of the term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fibrous structure comprising a first region and a second region, wherein the first region is directly connected to the second region without an intermediate transition region, wherein a ratio of the first region density to the second region density is greater than 1.6 wherein the first region is in the form of a continuous network throughout the fibrous structure and the second region is in the form of discrete regions dispersed throughout the first region.

2. The fibrous structure according to claim 1 wherein the fibrous structure comprises a non-naturally occurring pulp fiber.

3. The fibrous structure according to claim 2 wherein the non-naturally occurring pulp fiber is derived from a naturally occurring pulp fiber.

4. The fibrous structure according to claim 3 wherein the naturally occurring pulp fiber is obtained from a hardwood tree.

5. The fibrous structure according to claim 1 wherein the fibrous structure exhibits a ratio of tensile breaking strength to PFR of greater than 4.0.

6. A single- or multi-ply sanitary tissue product comprising a fibrous structure according to claim 1.

7. A process for making a fibrous structure, the process comprising the step of creating a first region and a second region within a fibrous structure, wherein the first region is directly connected to the second region without an intermediate transition region, wherein a ratio of the first region density to the second region density is greater than 1.6 wherein the first region is in the form of a continuous network throughout the fibrous structure and the second region is in the form of discrete regions dispersed throughout the first region.

* * * * *